US006327458B1

(12) United States Patent
Chapman

(10) Patent No.: US 6,327,458 B1
(45) Date of Patent: Dec. 4, 2001

(54) METHOD AND APPARATUS FOR POSITIONING PAPER IN AN IMAGING SYSTEM HAVING AN INTERMEDIATE TRANSFER MEDIUM

(75) Inventor: Danny Keith Chapman, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/545,202

(22) Filed: Apr. 6, 2000

(51) Int. Cl.[7] ..... G03G 15/00

(52) U.S. Cl. ..... 399/394; 399/302; 399/308; 399/396

(58) Field of Search ..... 399/394, 396, 399/381, 388, 302, 308; 271/226, 227, 242, 264, 265.01, 265.02, 270

(56) References Cited

U.S. PATENT DOCUMENTS

| | | | |
|---|---|---|---|
| 4,144,539 | 3/1979 | Davie et al. . | |
| 4,353,020 | 10/1982 | Veale . | |
| 4,734,868 | 3/1988 | DeLacy . | |
| 5,112,038 | 5/1992 | Dunaway . | |
| 5,235,392 | 8/1993 | Hediger . | |
| 5,394,223 | 2/1995 | Hart et al. . | |
| 5,452,073 | 9/1995 | Kataoka . | |
| 5,499,092 | 3/1996 | Sasaki . | |
| 5,508,789 | 4/1996 | Castelli et al. . | |
| 5,600,424 | 2/1997 | Malachowski . | |
| 5,655,199 | 8/1997 | Yamashita et al. . | |
| 5,678,159 | 10/1997 | Williams et al. . | |
| 5,701,566 | 12/1997 | Bisaiji et al. . | |
| 5,717,980 | 2/1998 | Oka et al. . | |
| 5,731,680 | 3/1998 | Winterberger et al. . | |
| 5,740,492 | 4/1998 | Deki et al. . | |
| 5,771,432 | 6/1998 | Nakayama . | |
| 5,794,176 | 8/1998 | Milillo . | |
| 5,818,478 | 10/1998 | Gibson . | |
| 5,828,387 | 10/1998 | Wataya et al. . | |
| 5,907,333 | 5/1999 | Patil et al. . | |
| 5,983,066 * | 11/1999 | Abe et al. | 399/394 |
| 6,014,542 * | 1/2000 | Hozumi et al. | 399/394 |
| 6,137,989 * | 10/2000 | Quesnel | 399/394 |
| 6,185,396 * | 2/2001 | Aizawa et al. | 399/302 X |

* cited by examiner

*Primary Examiner*—Arthur T. Grimley
*Assistant Examiner*—Hoan Tran
(74) *Attorney, Agent, or Firm*—Ronald K. Aust; John J. McArdle, Jr.

(57) ABSTRACT

A method of media-to-image registration sets a top writing line margin on a print medium within an electrophotographic machine. Movement of a substantially stationary sheet of print medium along a print medium path within the electrophotographic machine is initiated. An image associated with the sheet of print medium is scanned onto a developing unit. The scanning step commences before the initiating step. Toner is adhered to the image on the developing unit. The toner is transferred from the developing unit to a moving toner transfer medium. The electrophotographic machine is provided with a toner transfer area in which the toner can be transferred to the moving sheet of print medium. A speed of the movement of the sheet of print medium is adjusted such that the toner is transferred from the moving toner transfer medium to a desired area on the sheet of print medium within the toner transfer area. The sheet of print medium moves substantially continuously between the initiating step and a time of the transfer of the toner to the sheet of print medium.

35 Claims, 3 Drawing Sheets

METHOD AND APPARATUS FOR POSITIONING PAPER IN AN IMAGING SYSTEM HAVING AN INTERMEDIATE TRANSFER MEDIUM

BACKGROUND OF THE INVENTION

1. Field of the Invention

The present invention relates to imaging systems, and, more particularly, to a method of controlling paper position in a printing apparatus, such as an electrophotographic machine.

2. Description of the Related Art

In known electrophotographic machines, a sheet of paper is picked from an input device, such as a paper tray, prior to the start of the imaging process on a developing unit. As the paper moves through the paper path at a constant speed, the leading edge of the paper eventually trips a paper path sensor which signals the machine to commence imaging onto the developing unit. The image is laid down on a single rotating photoconductive drum in the developing unit. Eventually, the image on the drum is transferred to a transfer medium and then onto a sheet of paper which contacts the transfer medium at a precise point in time in order to establish a desired top writing line margin. This process is repeated for each individual sheet of paper, allowing the machine the luxury of waiting until each page is at a known location in the paper path before beginning the imaging process. Since the paper is picked prior to imaging, thereby allowing the electrophotographic process to wait for the paper to arrive at a certain location before commencing imaging, the margin above the top writing line on the paper can be accurately controlled.

It may be desirable or necessary to design an electrophotographic machine such that imaging is begun on a developing unit before the sheet of paper is even picked from the input device. This requirement may be due to size limitations on the printer which reduce the maximum length of the paper path. It may also be due to the use of multiple developing units, each transferring an image of a respective color onto a same location on the transfer medium. That is, after an image is first scanned onto a photoconductive drum for a first color, the image is transferred onto an intermediate transfer medium belt. The belt then moves over to receive an image of a second color from a second photoconductive drum. The second image is received on top of and overlaps the first image. This process repeats for each of the photoconductive drums, and the completed composite image eventually reaches the paper transfer nip where it is transferred from the intermediate transfer medium belt onto the paper. Since additional time is required for transferring a separate image from each developing unit sequentially, it may be necessary to begin imaging on at least a first of the developing units before the paper is picked from the input device.

A problem is that, after being picked, the paper can have several millimeters of error in the paper path. This error can be due to, for example, irregular pick times, paper stack height, and/or slippage. Thus, if the movement of the paper along the paper path continues at a constant speed, the paper will arrive at the toner transfer nip at an incorrect time. This results in a very unpredictable and inconsistent top writing line margin.

What is needed in the art is a method of media-to-image registration that eliminates errors in the size of a top writing line margin that are caused by commencing an imaging process onto an intermediate transfer medium before a sheet of paper is picked from an input device.

SUMMARY OF THE INVENTION

The present invention provides a method of accurately adjusting the position and speed of a sheet of paper in a paper path such that the paper arrives at a toner transfer nip at the same time as the image that the paper is to receive, and at an optimum speed for an accurate top writing line margin.

The invention comprises, in one form thereof, a method of setting a top writing line margin on a print medium within an electrophotographic machine. Movement of a substantially stationary sheet of print medium along a print medium path within the electrophotographic machine is initiated. An image associated with the sheet of print medium is scanned onto a developing unit. The scanning step commences before the initiating step. Toner is adhered to the image on the developing unit. The toner is transferred from the developing unit to a moving toner transfer medium. The electrophotographic machine is provided with a toner transfer area in which the toner can be transferred to the moving sheet of print medium. A speed of the movement of the sheet of print medium is adjusted such that the toner is transferred from the moving toner transfer medium to a desired area on the sheet of print medium within the toner transfer area. The sheet of print medium moves substantially continuously between the initiating step and a time of the transfer of the toner to the sheet of print medium.

An advantage of the present invention is that the top writing line margin can be accurately controlled even in cases where imaging begins before the paper is picked from the input device.

Another advantage is that the paper does not have to be gated or staged in the paper path.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

The exemplification set out herein illustrates one preferred embodiment of the invention, in one form, and such exemplification is not to be construed as limiting the scope of the invention in any manner.

DETAILED DESCRIPTION OF THE INVENTION

Figure 1:
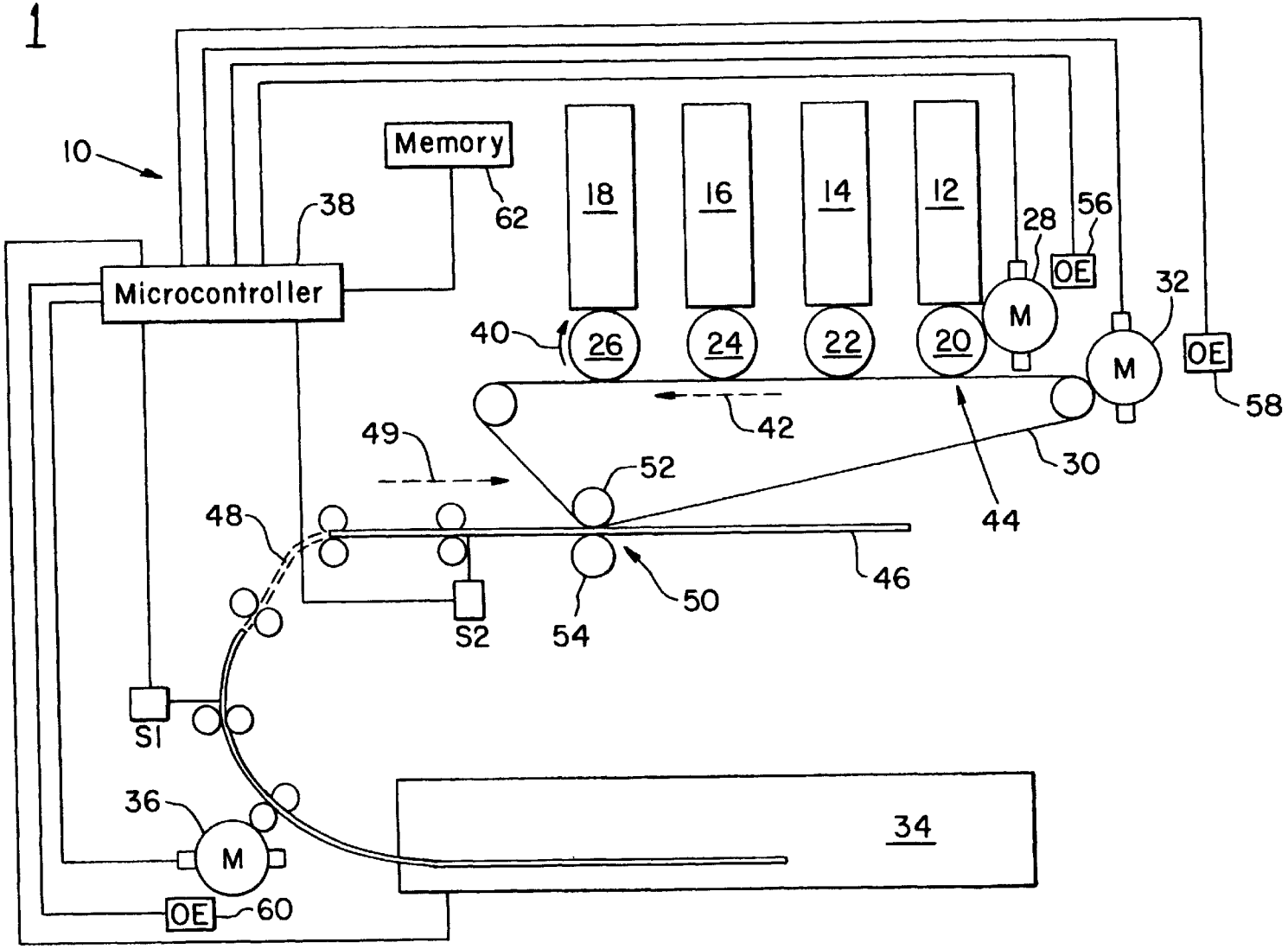
FIG. 1 is a partial, schematic, side view of one embodiment of a laser printer in which the method of the present invention may be used.

Referring now to the drawings, and, more particularly, to FIG. 1, there is shown one embodiment of a multicolor laser printer 10 including toner cartridges 12, 14, 16, 18, photoconductive drums 20, 22, 24, 26, a drum motor 28, an intermediate transfer member belt 30, a belt motor 32, an input paper tray 34, a paper path motor 36, paper path sensors S1, S2, and a microcontroller 38.

Each of four laser print heads (not shown) scans a respective laser beam in a scan direction, perpendicular to the plane of FIG. 1, across a respective one of photoconductive drums 20, 22, 24 and 26. Each of photoconductive drums 20, 22, 24 and 26 is negatively charged to approximately −900 volts and is subsequently discharged to a level of approximately −200 volts in the areas of its peripheral surface that are impinged by a respective one of the laser beams. During each scan of a laser beam across a photoconductive drum, each of photoconductive drums 20, 22, 24 and 26 is continuously rotated, clockwise in the embodiment shown, in a process or "cross-scan" direction indicated by direction arrow 40. The scanning of the laser beams across the peripheral surfaces of the photoconductive drums is cyclically repeated, thereby discharging the areas of the peripheral surfaces on which the laser beams impinge.

The toner in each of toner cartridges 12, 14, 16 and 18 is of a separate, respective color, such as cyan, magenta, yellow and black. Thus, each of the four laser print heads controls printing in a respective color, such as cyan, magenta, yellow or black. Further, the toner in each of toner cartridges 12, 14, 16 and 18 is negatively charged to approximately −600 volts. Thus, when the toner from cartridges 12, 14, 16 and 18 is brought into contact with a respective one of photoconductive drums 20, 22, 24 and 26, the toner is attracted to and adheres to the portions of the peripheral surfaces of the drums that have been discharged to −200 volts by the laser beams. As belt 30 rotates in the direction indicated by arrow 42, the toner from each of drums 20, 22, 24 and 26 is transferred to the outside surface of belt 30 in a respective drum transfer nip 44. As a print medium, such as paper 46, travels along a paper path 48 in the direction indicated by arrow 49, the toner is transferred from belt 30 to the surface of the paper 46 in a paper transfer nip 50 between opposing rollers 52 and 54. Paper transfer nip 50 is also referred to herein as a "toner transfer nip".

Imaging begins, at least on first photoconductive drum 20, before a first sheet of paper 46 is picked from input tray 34. The image begins to be transferred onto transfer belt 30, and when the image on belt 30 reaches a point that is a certain distance away from nip 50, tray 34 receives a pick command from microcontroller 38.

By monitoring the printhead scan data, microcontroller 38 determines when the electrophotographic system begins to image on photoconductive drum 20. Microcontroller 38 then determines at what point in time the first line of the image is placed onto transfer belt 30 by monitoring, in addition to the scan data, the number of revolutions and rotational position of drum motor 28. Drum motor 28 drives photoconductive drum 20. Drum motor 28 may or may not also drive drums 22, 24 and 26. The number of revolutions and rotational position of drum motor 28 is ascertained by an encoder 56, as is well known in the art.

As the first writing line is transferred onto transfer belt 30, microcontroller 38 begins to track incrementally the position of the image on belt 30 by monitoring the number of revolutions and rotational position of belt motor 32. Similarly to drum motor 28, the number of revolutions and rotational position of belt motor 32 can be ascertained by another encoder 58. From the number of rotations and rotational position of belt motor 32, the linear movement of belt 30 and the image carried thereby can be directly calculated. Since both the location of the image on transfer belt 30 and the length of belt 30 between the first drum transfer nip 44 and paper transfer nip 50 is known, the distance remaining for the image to travel before reaching paper transfer nip 50 can also be calculated.

At some designated time, input tray 34 receives a command from microcontroller 38 to pick a sheet of paper. The sheet of paper moves through paper path 48 at a constant speed and eventually trips a paper path sensor S1. Microcontroller 38 immediately begins tracking incrementally the position of the paper by monitoring the feedback of yet another encoder 60, this one being associated with paper path motor 36. From the tracked distance traveled by the sheet of paper after tripping paper path sensor S1, and the known distance between S1 and paper transfer nip 50, the distance remaining for the sheet of paper to travel before reaching paper transfer nip 50 can be calculated.

The inter-sheet gap is small in comparison to the paper path length and the image path length. Thus, no adjustment to paper position can begin until the preceding sheet has been completely cleared from paper path 48. This is determined by monitoring another paper path sensor S2. By monitoring when the trailing edge of the preceding sheet has cleared sensor S2, microcontroller 38 can determine when the preceding sheet has exited the last driven rolls of motor 36, thereby allowing the correction of the position error of the current sheet to begin.

From the two calculated distances, i.e., from the image on belt 30 to nip 50 and from the current sheet of paper to nip 50, microcontroller 38 calculates a correction needed to remove position error of the paper relative to its image so as to enable the paper to arrive at transfer nip 50 at the time and speed required to produce an accurate top writing line margin with acceptable tolerance. The correction is accomplished by incrementally adjusting the linear speed of the paper through paper path 48 by incrementally changing the velocity of paper path motor 36. The speed of paper path motor 36 is increased or decreased depending upon whether the current sheet of paper is behind or ahead of a desired, target position.

The feedback from encoder 58 is used as an interrupt into microcontroller 38. The timing of this interrupt is chosen such that minimum bandwidth is required, e.g., approximately 1 ms between interrupts. Fixed time interrupts could also be used. Each time microcontroller 38 receives this interrupt, the error in the relationship between the image position and the paper position is determined. This position error is multiplied by a gain factor in a control equation that produces a new desired velocity for motor 36. If the error is zero, the velocity of paper path motor 36 is not changed from the nominal. If the sheet of paper is ahead of or behind the desired position, a new paper path motor speed that would reduce the error for that sampling point is calculated and then implemented by microcontroller 38. As the position error decreases, the amount of velocity change also decreases to the point that zero error produces the nominal velocity. The new, changed speed of paper path motor 36 is limited by minimum and maximum values in order to allow for reasonable power requirements, acceptable acoustics, and a stable control system. This also bounds the error that can be removed.

The new desired speed is then fed into a motor speed control algorithm within microcontroller 38. Feedback from encoder 60 is used to maintain the speed of motor 36 at the new desired speed, which may be unchanged if the sheet of paper is already "on schedule", i.e., at a proper point along paper path 48 in order to arrive at paper transfer nip 50 at the desired point in time and at the desired speed. A signal from encoder 60 is used as another interrupt into microcontroller 38. Again, the timing of the interrupt is chosen such that minimum bandwidth is required, e.g., approximately 1 ms between interrupts. The control code within microcontroller 38 sets the gain, encoder divide-by values (which sets interrupt timing), and other control parameters based upon the newly requested speed from the error correction routine. Each time microcontroller 38 receives this interrupt, microcontroller 38 uses the parameters to adjust the voltage applied to paper path motor 36 in order to maintain the desired speed.

The desired speed of paper path motor 36 is updated on every feedback pulse from belt motor encoder 58. These updates continue until the remaining distance between sheet of paper and paper transfer nip 50 is substantially zero. At this time, the speed of the sheet of paper is held constant, and the image is transferred onto the sheet of paper with a correct top writing line margin that is within the acceptable tolerance.

If the top writing line margin is not within the acceptable tolerance, it is possible that the error has been introduced by variances in the predetermined number of motor revolutions required to transport the paper from sensor S1 to paper transfer nip 50, and/or the predetermined number of motor revolutions required for the image to travel between photoconductive drum 20 and paper transfer nip 50. This new error is repeatable, and can be eliminated by allowing these values to be "tweaked" and stored in a nonvolatile memory 62 connected to microcontroller 38. For example, if a test print page shows that the top margin is out of specifications, then an operator can use a software utility to adjust the stored values that microcontroller 38 uses to calculate position errors. These stored values represent the distance between paper sensor S1 and paper transfer nip 50, and/or the length of transfer belt 30 between photoconductive drum 20 and paper transfer nip 50. By adjusting the stored values, the image can be moved up or down on the page by the adjusted amount. These values are stored and used for any and all future print pages. Thus, the adverse effects of the manufacturing tolerances of paper path 48 and transfer belt 30 can be eliminated.

Figure 2A:
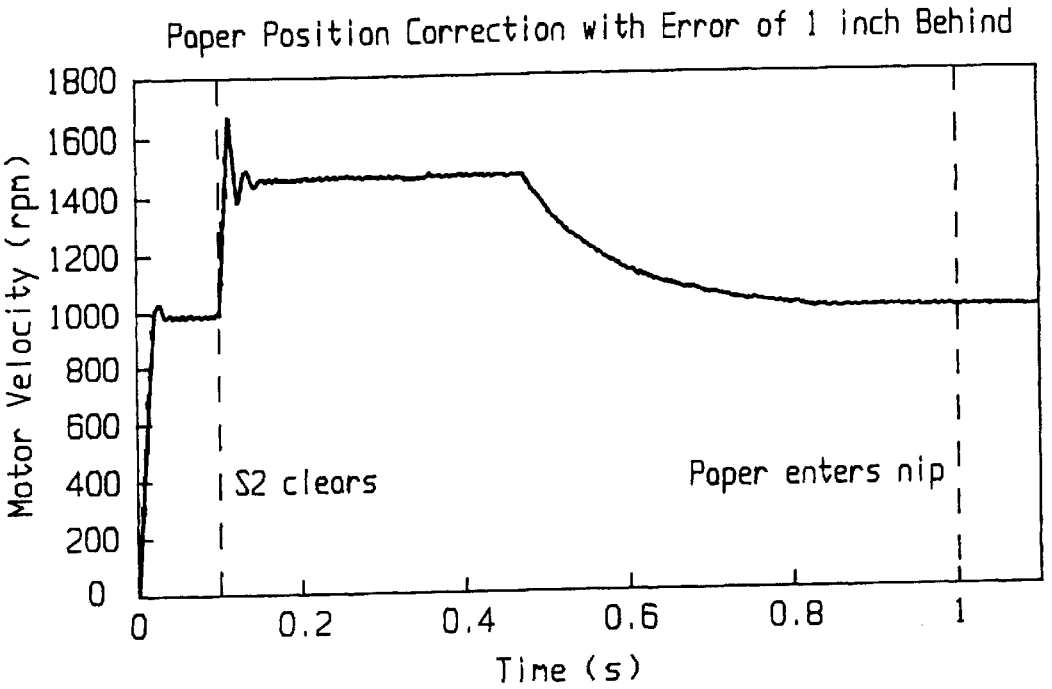
FIG. 2*a* is a plot of the speed of the paper transport motor of FIG. 1 versus time in an implementation of one embodiment of the method of the present invention.
Figure 2B:
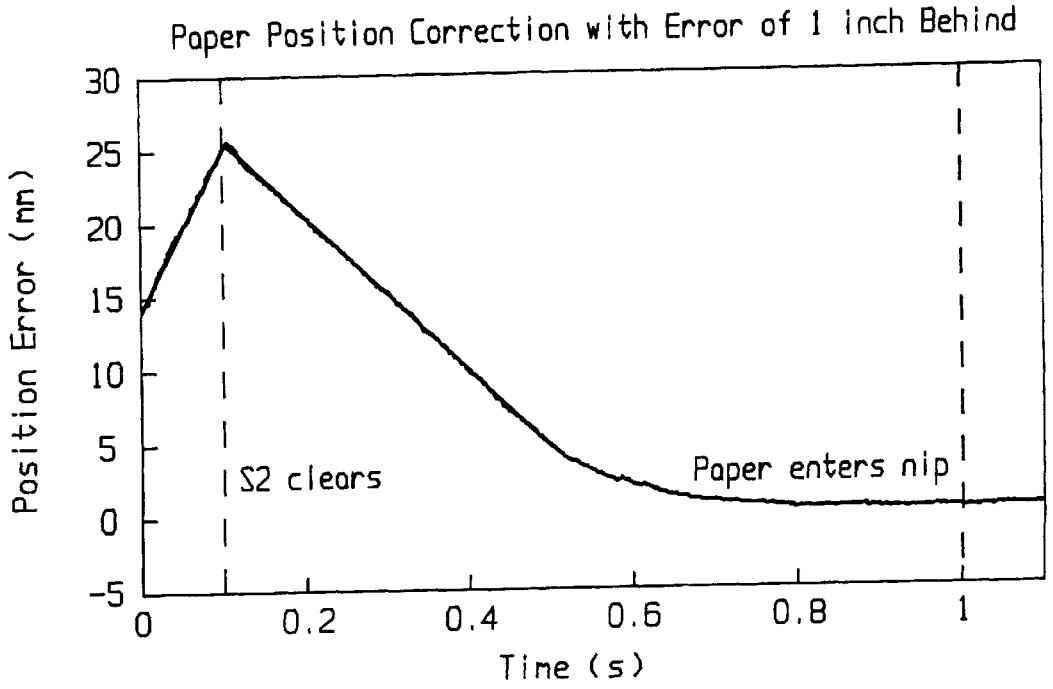
FIG. 2*b* is a plot of the paper position error versus time which may result from the paper transport motor plot of FIG. 2*a,*

A comparison of FIGS. 2*a* and 2*b* illustrates the operation of one embodiment of the method of the present invention. At time =0.1 second, the preceding sheet of paper clears sensor S2, and, as can be seen in FIG. 2*b*, the current sheet is one inch (25.4 mm) behind its desired location along paper path 48 at that point in time. Upon sensing that the current sheet is one inch behind, microcontroller 38 increases the speed of paper transport motor 36 from a steady-state speed of 1000 rpm to a higher steady-state speed of approximately 1475 rpm, as shown in FIG. 2*a*. Microcontroller 38 monitors the ensuing reduction in the paper position error, as illustrated in FIG. 2*b*. At time =0.48 second, when the paper position error is approximately 5 mm, microcontroller 38 begins to command speeds of motor 36 less than the maximum. The system continues to measure error and adjust the speed of motor 36. Eventually, the speed of paper transport motor 36 decays back down to the desired steady-state speed of 1000 rpm such that the sheet of paper enters nip 50 coincident with its image, which is at time of 1.0 second in this example. Thus, the paper position error is removed and motor 36 is returned to the nominal, steady-state paper path speed of 1000 rpm before the sheet of paper enters toner transfer nip 50. The speed of 1475 rpm is the maximum allowable desired speed in this embodiment.

Figure 3A:
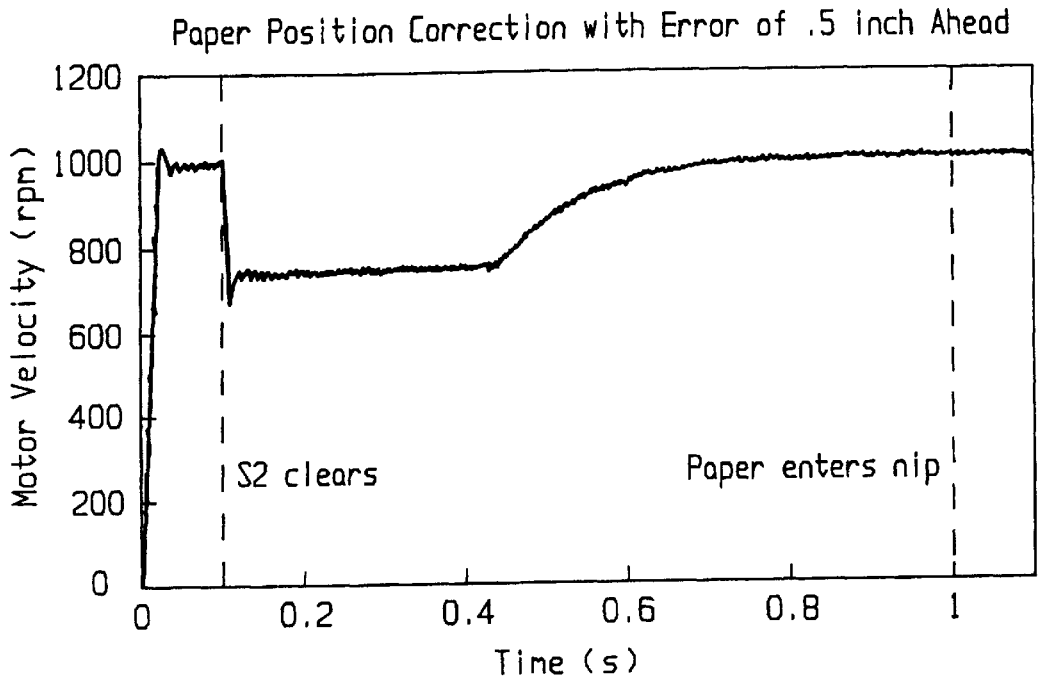
FIG. 3*a* is another plot of the speed of the paper transport motor of FIG. 1 versus time in an implementation of one embodiment of the method of the present invention.
Figure 3B:
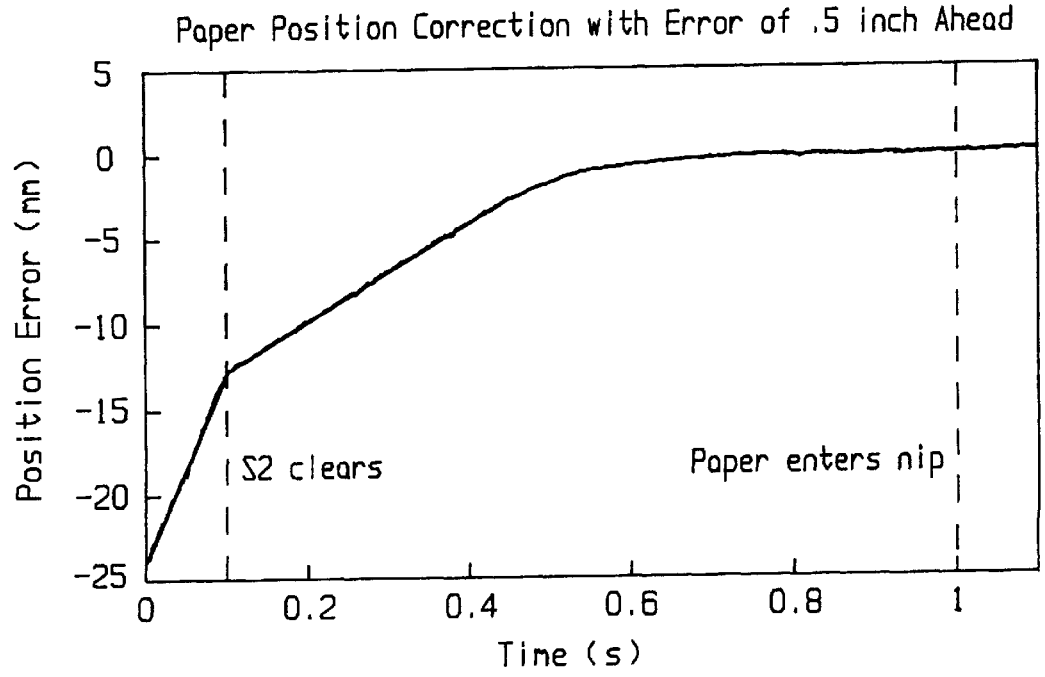
FIG. 3*b* is a plot of the paper position error versus time which may result from the paper transport motor plot of FIG. 3*a.*

A comparison of FIGS. 3*a* and 3*b* illustrates a second scenario wherein the sheet of paper is 0.5 inch (12.7 mm) ahead of its desired location along paper path 48 at time =0.1 second when the preceding sheet of paper clears sensor S2. Microcontroller 38 then decreases the speed of paper transport motor 36 from the steady-state speed of 1000 rpm to a lower steady-state speed of approximately 750 rpm, as shown in FIG. 3*a*. The speed of 750 rpm is the minimum allowable desired speed in this embodiment. Microcontroller 38 monitors the ensuing reduction in the paper position error, as illustrated in FIG. 3*b*. At time =0.43 second, when the paper position error is approximately −3 mm, microcontroller 38 begins to command speeds greater than the minimum. The system continues to measure error and adjust the speed of motor 36. Eventually the speed of paper transport motor 36 increases back up to the desired steady-state speed of 1000 rpm such that the sheet of paper enters nip 50 coincident with its image, which is at time of 1.0 second in this example. Thus, in this second scenario too, the paper position error is removed and motor 36 is returned to the nominal, steady-state speed of 1000 rpm before the paper enters toner transfer nip 50.

The present invention incorporates multiple feedback loops in a control system such that paper position errors introduced into the paper path can be effectively reduced in order to provide an accurate top writing line margin, and to allow the paper to be "handed-off" at an optimal speed into toner transfer nip 50. Feedback from the printhead scan data, drum motor 28, and toner transfer belt motor 32 are used to determine and track the image position on belt 30. Feedback from paper path sensors S1 and S2 and the signals from paper path motor encoder 60 are used to determine and track paper position. Position error can then be calculated between paper and image. The speed of paper path motor 36 is adjusted by microcontroller 38 to effectively remove the position error such that the paper arrives at transfer nip 50 coincident with the image and at the desired speed. Care is taken to keep the bandwidth demands on microcontroller 38 to a minimum by using a signal from belt motor encoder 58 to set the frequency of changes to the speed of paper transport motor 36, and by using a signal from paper transport motor encoder 60 to actually control the speed of paper transport. The speed of paper transport motor 36 is also carefully controlled to provide acceptable power levels, acoustics and stability.

All three encoders generate a predetermined number of pulses per revolution of the corresponding motor. Of course, it would be possible to use any or all of the known types of encoders, or another type of device that senses the rotation of a motor, or by which motor shaft position could be deduced.

While this invention has been described as having a preferred design, the present invention can be further modified within the spirit and scope of this disclosure. This application is therefore intended to cover any variations, uses, or adaptions of the invention using its general principles. Further, this application is intended to cover such departures from the present disclosure as come within know or customary practice in the art to which this invention pertains and which falls within the limits of the appended claims.

What is claimed is:

1. A method of media-to-image registration within an electrophotographic machine, said method comprising the steps of:

initiating movement of a substantially stationary sheet of print medium along a print medium path within the electrophotographic machine;

scanning an image onto a developing unit, said image being associated with the sheet of print medium. said scanning step commencing before said initiating step;

adhering toner to said image on said developing unit;

transferring the toner from said developing unit to a moving toner transfer medium;

providing the electrophotographic machine with a toner transfer area in which the toner can be transferred to the moving sheet of print medium; and adjusting a speed of said movement of the sheet of print medium approximately equal to a speed of said toner transfer medium before the sheet of print medium enters the toner transfer area, said adjusting being such that the toner is transferred from said moving toner transfer medium to a desired area on the sheet of print medium within said toner transfer area, the sheet of print medium moving substantially continuously between said initiating step and a time of said transfer of the toner to the sheet of print medium.

2. The method of claim 1, wherein said adhering step commences before said initiating step.

3. The method of claim 2, wherein said step of transferring the toner from said developing unit to said moving toner transfer medium commences before said initiating step.

4. The method of claim 3, wherein said step of transferring the toner from said developing unit to said moving toner transfer medium is completed before said initiating step commences.

5. The method of claim 1, wherein said initiating step includes picking the substantially stationary sheet of print medium from an input device.

6. The method of claim 1, wherein the print medium comprises paper.

7. The method of claim 1, wherein said transfer of the toner to the sheet of print medium includes pressing said toner transfer medium and the sheet of print medium together in a nip defined between two rollers.

8. The method of claim 1, wherein said adjusting step includes setting the speed of the sheet of print medium approximately equal to a speed of said toner transfer medium during said transfer of the toner to the sheet of print medium.

9. The method of claim 8, wherein said adjusting step includes:

maintaining the speed of the sheet of print medium at a steady-state speed approximately equal to the speed of said toner transfer medium;

temporarily modulating the speed of the sheet of print medium after said maintaining step; and returning the speed of the sheet of print medium to said steady-state speed approximately equal to the speed of said toner transfer medium before said transfer of the toner to the sheet of print medium.

10. A method of media-to-image registration within an electrophotographic machine, said method comprising the steps of:

providing the electrophotographic machine with a toner transfer area in which toner is transferred from a moving toner transfer medium to a print medium;

monitoring an incremental position of a moving sheet of the print medium along a print medium path within the electrophotographic machine;

monitoring an incremental position of a toned image on said moving transfer medium; and modulating a speed of the moving sheet of print medium along said print medium path dependent upon said monitoring of the print medium and said monitoring of said moving transfer medium, said modulating being such that a first predetermined point on the sheet of print medium contacts a second predetermined point on said moving toner transfer medium within said toner transfer area.

11. The method of claim 10, wherein said modulating step includes providing the sheet of print medium with a predetermined speed at substantially a same point in time as when the first predetermined point on the sheet of print medium contacts said second predetermined point on said moving toner transfer medium.

12. The method of claim 10, wherein said modulating step is dependent upon each of:

a first distance between the first predetermined point on the sheet and said toner transfer area at a selected point in time; and a second distance between said second predetermined point on said moving toner transfer medium and said toner transfer area at said selected point in time.

13. The method of claim 12, where said modulating step is also dependent upon the speed of the moving sheet at said selected point in time.

14. The method of claim 13, where said modulating step is also dependent upon a speed of said toner transfer medium at said selected point in time.

15. The method of claim 10, wherein said toner transfer area comprises a nip defined between two rollers, said toner transfer medium being pressed against the print medium in said nip.

16. The method of claim 10, wherein said step of monitoring an incremental position of a toned image on said moving transfer medium includes monitoring at least one of a number of revolutions and a rotational position of a belt motor.

17. The method of claim 16, wherein said step of monitoring an incremental position of a toned image on said moving transfer medium is performed using an encoder.

18. The method of claim 16, wherein said step of monitoring an incremental position of a toned image on said moving transfer medium comprises calculating the incremental position of the toned image on said moving transfer medium from the number of revolutions and the rotational position of said belt motor.

19. The method of claim 10, comprising the further step of sensing when a preceding sheet of the print medium has cleared from said print medium path, said modulating step occurring after said sensing step.

20. A method of positioning a sheet of print medium within an imaging apparatus, said method comprising the steps of:

moving the sheet of print medium along a print medium path within the imaging apparatus;

incrementally calculating at least one temporary change in speed that is necessary to enable the sheet of print medium to arrive at a predetermined point along the print medium path at a predetermined point in time and with a predetermined speed;

temporarily changing a speed of the sheet of print medium according to said calculating step;

after said temporarily changing step, changing said speed of the sheet of print medium to said predetermined speed; and maintaining said speed of the sheet of print medium at said predetermined speed until the sheet of print medium arrives at the predetermined point along the print medium path at the predetermined point in time and with said predetermined speed.

21. The method of claim 20, wherein said speed of the sheet of print medium is maintained at said predetermined speed during said moving step and before said temporarily changing step.

22. The method of claim 21, wherein said imaging apparatus comprises an electrophotographic machine.

23. The method of claim 21, wherein said calculating step includes incrementally determining a distance between the sheet of print medium and the predetermined point along the print medium path.

24. The method of claim 23, wherein said predetermined point along the print medium path comprises a toner transfer nip within the imaging apparatus, said predetermined point in time comprising a time at which a selected point on a moving toner transfer medium arrives at said toner transfer nip.

25. The method of claim 21, wherein said calculating step includes incrementally determining a distance between an image on a transport medium and the predetermined point along the print medium path.

26. The method of claim 20, wherein said at least one temporary change in speed comprises a plurality of temporary changes in speed.

27. An electrophotographic machine, comprising:

a toner transfer area;

a toner transfer medium configured for moving at a constant speed and transferring toner to a sheet of print medium within said toner transfer area;

a print medium transport device configured for transporting the sheet of print medium along a print medium path toward said toner transfer area; and a control device configured for:

monitoring an incremental position of the sheet of print medium along the print medium path;

monitoring an incremental position of a toned image on said moving transfer medium; and modulating a speed at which the sheet of print medium is transported by said print medium transport device dependent upon said monitoring of the print medium and said monitoring of said moving transfer medium, said modulating being such that a first point on the sheet of print medium contacts a second point on the toner transfer medium within said toner transfer area.

28. The electrophotographic machine of claim 27, wherein said toner transfer medium comprises a toner transfer belt.

29. The electrophotographic machine of claim 27, wherein said toner transfer area comprises a toner transfer nip defined between two opposing rollers.

30. The electrophotographic machine of claim 27, wherein said print medium transport device includes a paper path motor configured for transporting paper at a selected one of a plurality of speeds.

31. The electrophotographic machine of claim 27, further comprising at least one print medium sensor disposed along the print medium path, said at least one print medium sensor being configured for sensing the sheet of print medium passing by said at least one print medium sensor.

32. The electrophotographic machine of claim 31, wherein said control device is configured for modulating a speed at which the sheet of print medium is transported by said print medium transport device dependent upon a calculation using a position of the print medium and a position of a toned image on the toner transfer medium at a time at which said at least one print medium sensor senses the sheet of print medium passing by said at least one print medium sensor.

33. The electrophotographic machine of claim 31, where said at least one print medium sensor comprises at least a first print medium sensor and a second print medium sensor, said first print medium sensor being configured to sense a position of the sheet of print medium along the print medium path, said second print medium sensor being configured to sense when a preceding sheet of print medium clears from the print medium path.

34. The electrophotographic machine of claim 33, wherein said print medium transport device includes a plurality of pairs of driven rolls, said first print medium sensor being disposed before a last of said pairs of driven rolls, said second print medium sensor being disposed immediately after said last pair of driven rolls.

35. The electrophotographic machine of claim 27, wherein said control device is configured for initiating modulation of the speed at which the sheet of print medium is transported by said print medium transport device prior to the print medium being sensed by a print medium sensor.

* * * * *